United States Patent [19]

Zajac

[11] Patent Number: 4,842,216

[45] Date of Patent: Jun. 27, 1989

[54] FOLDING CONE PACKAGE DESIGN

[75] Inventor: Ronald E. Zajac, Goldens Bridge, N.Y.

[73] Assignee: Windings, Inc., Goldens Bridge, N.Y.

[21] Appl. No.: 191,196

[22] Filed: May 6, 1988

[51] Int. Cl.[4] ..... B65H 55/02

[52] U.S. Cl. ..... 242/163; 242/170; 242/137.1; 206/389; 206/397; 206/416

[58] Field of Search ..... 242/163, 170, 171, 172, 242/159, 129, 134, 137, 137.1, 138, 146, 132; 206/389, 392, 395, 396, 397, 407, 408, 409, 413, 416

[56] References Cited

U.S. PATENT DOCUMENTS

| | | | |
|---|---|---|---|
| 3,178,130 | 4/1965 | Taylor, Jr. | 242/163 |
| 3,677,491 | 7/1972 | Gerwig | 242/163 |
| 3,689,005 | 9/1972 | Newman | 242/163 |
| 3,877,661 | 4/1975 | Newman | 242/163 |
| 3,923,270 | 12/1975 | Newman et al. | 242/163 |
| 4,019,636 | 4/1977 | Wise | 206/396 |
| 4,160,533 | 7/1979 | Kotzur et al. | 242/137.1 |
| 4,367,853 | 1/1983 | Kotzur | 242/163 |
| 4,406,419 | 9/1983 | Kotzur | 242/163 |

*Primary Examiner*—Stanley N. Gilreath
*Attorney, Agent, or Firm*—Watson, Cole, Grindle & Watson

[57] ABSTRACT

A folding cone for retaining the windings of a wound package containing coils wound in a Figure-8 configuration with an axial opening extending through the longitudinal axis of the coil and a radial opening extending from the inner surface to the outer surface of the coils with a first member having a base portion including a pair of upstanding projections extending along the bottom thereof with a gap therebetween and an end portion shaped to be positioned within the inner end surface of the coils. The end portion and base portion extend to the gap and include spaced guide members each having opposed spaced porjections forming a channel and a second member having a second base portion and a second opposed end portion connected to the second base portion with the second base portion and second end portion being interconnected by at least a second strip member connected substantially perpendicular to the second base portion by a second fold strip, the second end portion being narrower than said second base member and being shaped to be positioned within the inner surface of the coil windings, the second strip member having an edge portion with an enlarged portion along a section thereof and adapted to be engagable in said channels with the second end portion folded perpendicular to the second base portion along the second fold line and the second base portion folded perpendicular to the first base member and the folding cone formed thereby being adapted to be held by the enlarged portion being retained in one of the channels.

6 Claims, 3 Drawing Sheets

FOLDING CONE PACKAGE DESIGN

BACKGROUND OF THE INVENTION

1. Field of the Invention

This invention relates to the packaging of wound material, and in particular to such packaging in containers using inserts for retaining the wound material in its coiled or wound form both during retention within the container and during unwinding of the material, and even more particularly to a folding cone used as the insert and the wound package of material including the folding cone.

The wound material preferably comprises flexible material such as electrical conductor that is wound in a FIG. 8 configuration with at least one radial hole extending from the outside of the wound material to the inner core thereof such that the flexible material may be unwound or paid-out from the innermost winding through the radial hole. Method and apparatus for winding flexible material in such a FIG. 8 configuration are disclosed in U.S. Pat. Nos. 3,178,130 and 4,406,419, assigned to the same Assignee as the present application.

2. Related Art

U.S. Pat. No. 3,677,491 discloses a package for a wind of flexible material in which the wind is enclosed in a box having end-forming flaps hinged about axes perpendicular to the axial opening of the wind. The end-forming flaps include tapered members, such as truncated pyramids, projecting inwardly from the end walls, with the pyramids formed by the folding of a blank of cardboard, which has extendable flaps inter-engaged with the end flaps of the box to hold the pyramids in position.

U.S. Pat. No. 4,019,636 relates to a dispensing package of coiled strand material wherein a series of connected walls form a perimeter around the coil, and each of the walls has opposed hinged flaps. Tabs on each side of the coil interlock to form a tapered boss extending into the open center of the coil spaced from, but facing, the like opposing boss.

U.S. Pat. No. 4,160,533 discloses a packaqe for retaining wound material within a container having a perforated corner portion for feeding material from the winding. The bottom and upper surfaces of the container include intersecting cone sections for supporting the inner windings of the material.

In the above containers, the operator has to make up the box or container, open the flaps and align the coil with the payout hole in the side of the winding and then close the flaps—often damaging the end portions of the cardboard cones formed in opposing end members of flaps of the container.

There have been other attempts to provide support for a containerized winding such as the cone elements and configuations disclosed in each of U.S. Pat. Nos. 3,689,005, 3,877,661, and 3,923,270. Thus, U.S Pat. No. 3,689,005 discloses conical members with rounded points extending into the axial space within the wound package from each end, with the tips of the conical members being spaced apart by a distance only slightly greater than the greatest cross-sectional dimension of the flexible material, or being movable apart to provide such a spacing. The conical members are supported by the walls of the container.

In U.S. Pat. No. 3,877,661, the wound package is mounted on opposed conical members which are directed towards each other and inserted into the ends of the axial space of the winding within the wound package.

In U.S. Pat. No. 3,923,270, a wound package is provided with tapered members within the axial opening of the wind to guide the individual coils of the material as they are withdrawn, with solid material being arranged in the space between the cones and the inner wall of the container with the solid material being held against the inside coils of the package, thereby preventing inward collapse of the inner wall of the package during shipment and handling.

One of the disadvantages of cones formed as integral portions of, for example, the end flaps of the carton is that the end flaps are weakened by the presence of the cones. The operator of a winding machine has to assemble the carton and arrange the cones to be aligned with the payout tube in the wound coil and then close the flaps which often results in damage to the end cones made of cardboard.

SUMMARY OF THE INVENTION

The present invention utilizes foldable cones molded from polypropylene or plastic material into an essentially two-part foldable planar form with upstanding projections representative of desired features of the cone and, including designated fold strips enabling the two parts of the cone to be folded along the fold strips and assembled into an operable cone element. The essentially planar structure of the unassembled cone elements affords a means of storing such elements in a minimum amount of space. Each of the two-part elements includes respective guide and retention members engagable with one another to maintain an assembled cone in an assembled state.

The folding cones of the subject invention are made from flat molds and take up minimal storage space. The folding cones are designed to be inserted into the open end of a wound coil as described, supra, to maintain the coil during packaging into specially constructed cartons and during payout of the wind from the inside.

With the foldable cones of the present invention, the operator of a winding machine inserts the payout tubes into the radial opening of the finished coil. The coil is then compressed in a specially constructed jig and the compressed coils are then inserted into the carton (having the foldable cones attached to the side panels thereof) by means of a ram, thereby inserting one pair of cones into one open end of the coil. The operator then closes the container ensuring that the other open end of the coil receives the cones and closes the end flaps of the carton to seal it.

The foldable cones of the present invention afford a stronger support for wound packages of flexible material than do the former cones die cut into the end flaps of the cardboard carton and enable the wound coils to be assembled into the carton more easily than with cones of known construction.

BRIEF DESCRIPTION OF THE DRAWINGS

The above objects, advantages and features of the invention are readily apparent from the following description of a preferred embodiment of the best mode of carrying out the invention when taken in conjunction with the drawings, wherein.

DETAILED DESCRIPTION OF THE PREFERRED EMBODIMENT

Figure 1:
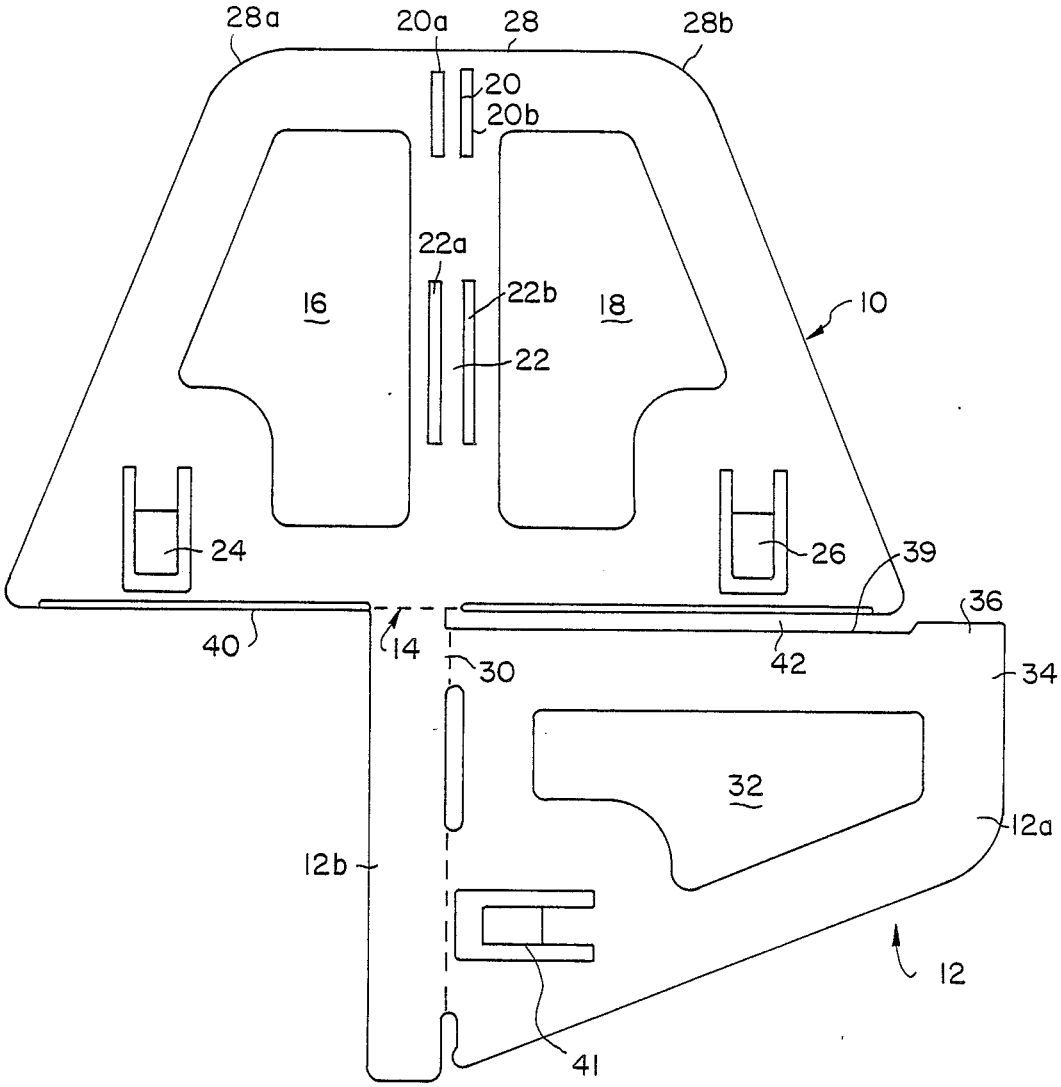
FIG. 1 is a top view of the unassembled two-part folding cone.
Figure 2:
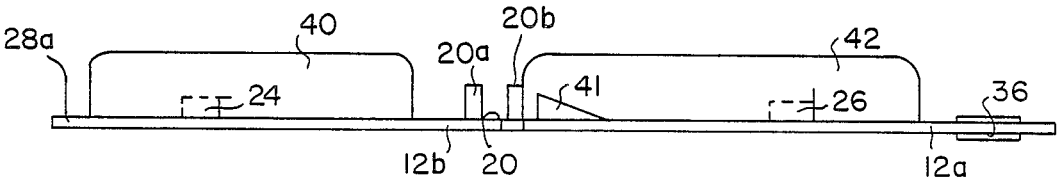
FIG. 2 is a side view of the unassembled two-part folding cone.

The two-part folding cone illustrated in FIG. 1 has element 10 foldably attached to element 12 along fold line 14. Element 10 is formed with cut-out portions 16, 18, upstanding spaced pairs of guide members 20 and 22, each respectively consisting of guide bar pairs **20*a*, 20*b* and 22*a*, 22*b* each of which pairs is spaced to retain a portion of the other element 12 when the latter is folded into operative position with element 10. Retainers 24 and 26 are formed toward the bottom of element 10** to retain the foldable cone element in the end flap of the carton as is well known to those skilled in the packaging art.

Element 10 includes an end portion 28 with radii **28*a* and 28*b*** that form structure for engaging portions of the inner wind of the wound coil.

Element 12 includes a further fold line 30 such that upper portion **12*a* and lower portion 12*b* can be folded about fold line 30 to be substantially perpendicular with one another. Upper portion includes cut-out portion 32 and end portion 34 including projection 36 which engages spaced guide and retaining members 20*a* and 20*b* with element 12 folded into an operative position with element 10 such that leading edge 38 of element 12 is engaged between guide members 20 and 22 of element 10, which condition is obtained with upper portion folded about fold axis 30 and then folded about fold axis 14. Enlarged projection 36 is engaged between guide members 20*a* and 20*b*. Element 12 also includes retainer 41 for engaging a portion of the end flap of the carton, which cooperates with strip 12*b*** to retain the cone on the flap, side or end portion of a carton.

The portion of the carton is retained between retainers 24, 26 and projecting strips 40, 42, respectively and between retainer 41 and projecting strip **12*b***.

Figure 3:
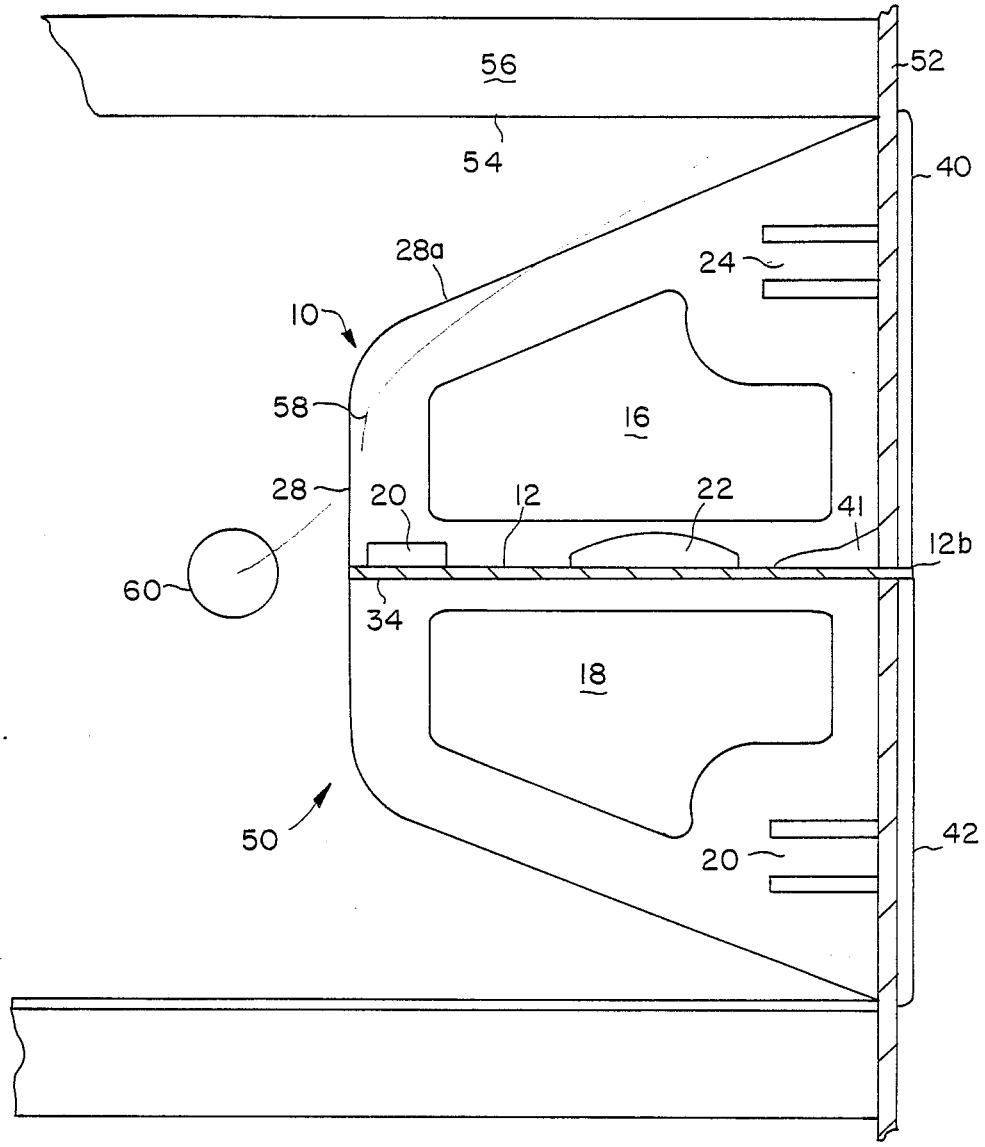
FIG. 3 is a cross-sectional view showing the two-part folding cone in an assembled state mounted to the side of a carton and within the end portion of a coil for supporting the windings thereof.

FIG. 3 is a side cross-sectional view illustrating a folding cone 50, with elements 10 and 12 folded into operative position such that end portion 34 is substantially perpendicular to end portion 28. A portion 52 of a side, end or flap section of carton is shown extending between retainers 24, 26 and 41 whereby the assembled cone 50 is retained inside the carton within the inner surface 54 of wound coil 56 such that the wound material 58 can be unwound from the inner surface of the wound coil over upper surface **28*a* of the folding cone 10 and through payout tube 60 inserted in a radial opening of the coil 56**.

Another assembled cone is mounted in the same section 52 of the carton on the other side of the folding cone 10 shown in FIG. 3 to form a three dimensional cone surface for supporting the wound coil 56 within the carton to keep the wound coil from collapsing during shipment and storage as well as to assist the unwinding of the coiled material 58) as it is being withdrawn from the inner surface 54 through payout tube 60, thereby preventing bird-nesting and fouling of the wound material as it is being paid out.

The folding cones can be readily assembled into operative position and fastened to appropriate slit portions in section 5 of the side, end or flap of a carton. Thus, the folding cones of the invention are believed to represent a distinct improvement over prior art cone structure at least in their ease of assembly and insertion into a carton and that when stored they do not take up much space.

It is understood that another pair of back-to-back folding cones are inserted in the other opening of the wound coil 56, thereby providing support at each end portion of the winding. The carton is then closed and ready for shipment.

Figure 4:
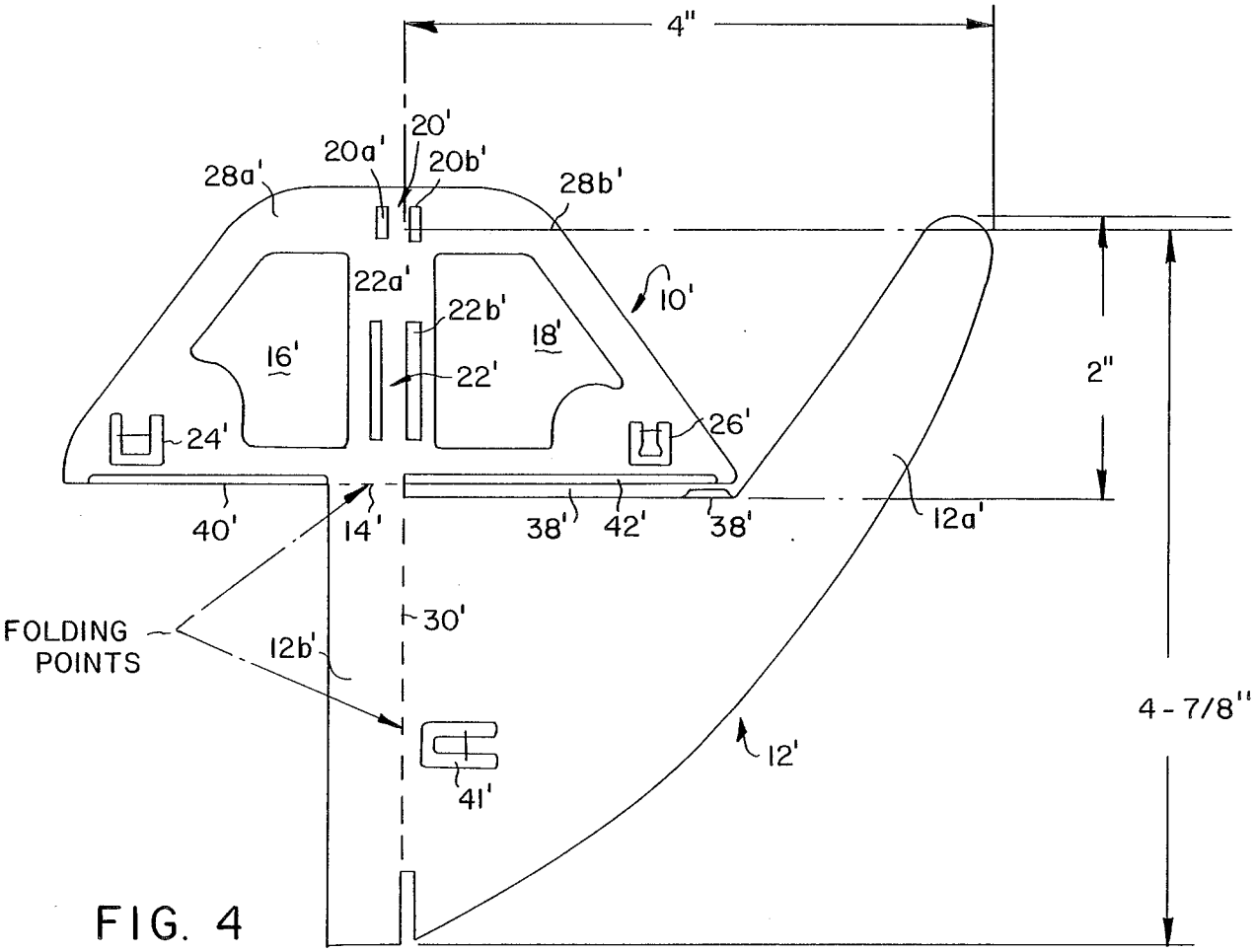
FIG. 4 shows another embodiment of a two-part folding cone with different shaped end portions showing the versatility of the folding cone design.

FIG. 4 illustrates a modified embodiment of the folding cone struction in which the shape of the upper portion **12*a*' differs from the shape of upper portion 12*a* of FIG. 1. All of the other elements of the folding cone are essentially the same as that of FIG. 1 and bear the same legends marked with a prime. The purpose of the scimitar-shaped portion 12*a*' is to accommodate different types of wound materials having different flexibility characteristics. For example, the scimitar shape of portion 12*a*' is useful for retaining wound optical fiber material and the like as disclosed in U.S. Pat. No. 4,367,853 entitled "Scimitar-Shaped Guide and Support Member" and assigned to the same Assignee as the present invention. It is evident that upper portion 12*a*' must extend beyond enlarged retainer portion 38' so that portion 12' will fold over fold line 14' and extend above upper sections 28*a*' and 28*b*'** when the cone is folded into operative position.

The above description serves only to describe exemplary embodiments of the best mode of making the folding cone to demonstrate its construction and operation. Thus, the invention is not intended to be limited thereby, as those skilled in the packaging of wound coiled material will readily perceive modifications of the above-described embodiments. The invention is intended to be limited only by the following claims and the equivalents to which the claimed components are entitled.

What is claimed is:

1. A folding cone for retaining the windings of a wound package containing coils wound in a FIG. 8 configuration with an axial opening extending through the longitudinal axis of the coil and a radial opening extending from the inner surface to the outer surface of the coils, comprising:

a first member having a base portion and an opposed end portion, said base portion including a pair of upstanding projections extending along the bottom thereof with a gap therebetween, said end portion having a narrower width than said base portion and being shaped to be positioned within the inner surface of said coils;

said base portion and end portion being interconnected by a strip portion extending to said gap and including spaced guide members each having opposed spaced projections forming a channel;

a second member having a second base portion and a second opposed end portion and being connected to said first member by a fold line extending in said gap and connected to said second base portion, said second base portion and said second end portion being interconnected by at least a second strip member connected substantially perpendicularly to said second base portion by a second fold strip, said second end portion being narrower than said second base member and being shaped to be positioned within the inner surface of said coil windings, said second strip member having an edge portion with an enlarged portion along a section thereof and adapted to be engagable in said channels with said second end portion folded perpendicular to said second base portion along said second fold line and said second base portion folder perpendicular to said first base member and the folding cone formed thereby being adapted to be held by said enlarged portion being retained in one of said channels.

2. A folding cone as claimed in claim 1, wherein the first and second base portions each include means for attaching the folding cone to a portion of a carton for storing said wound package.

3. A folding cone as claimed in claim 2, wherein said means for attaching each comprises a flexible strip cut from said first and second base portion.

4. A wound package, comprising:

coils of flexible material wound in a FIG. 8 configuration with an axial opening extending through eh longitudinal axis of the coils and radial opening extending from the inner surface to the outer surface of the coils.

a carton for holding said coils of flexible material and including respective opposing side portions adjacent the opposed ends of the axial opening of said coils;

a pair of cone members inserted into each respective axial opening to support the inner windings of said coils and being mounted to a respective one of said opposing side portions for retaining said coils within said carton, each of said pair of cone members comprising:

a first member having a base portion and an opposed end portion, said base portion including a pair of upstanding projections extending along the bottom thereof with a gap therebetween, said end portion having a narrower width than said base portion and being shaped to be positioned within the inner surface of said coils;

said base portion and end portion being interconnected by a strip portion extending to said gap and including spaced guide members each having opposed spaced projections forming a channel;

a second member having a second base portion and a second opposed end portion and being connected to said first member by a fold line extending in said gap and connected to said second base portion, said second base portion and said second end portion being interconnected by at least a second strip member connected substantially perpendicularly to said second base portion by a second fold strip, said second end portion being narrower than said second base member and positioned within the inner surface of said coil windings, said second strip member having an edge portion with an enlarged portion along a section thereof and engaged in said channels with said second end portion folded perpendicular to said second base portion along said second fold line and said second base portion folded perpendicular to said first base member and the folding cone formed thereby being held by said enlarged portion being retained in one of said channels.

5. A wound package as set forth in claim 4, wherein the first and second base portions each include means for attaching the folding cone to said opposing side portions.

6. A wound package as claimed in claim 5, wherein said means for attaching each comprises a flexible strip cut from said first and second base portion.

* * * * *